US006444292B1

(12) United States Patent
Legl

(10) Patent No.: US 6,444,292 B1
(45) Date of Patent: Sep. 3, 2002

(54) NEEDLE BOARD FOR A DEVICE FOR NEEDLING A WEB

(75) Inventor: Ludwig Legl, Buchkirchen (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 09/502,926

(22) Filed: Feb. 11, 2000

(30) Foreign Application Priority Data

Feb. 15, 1999 (AU) ..... 213/99

(51) Int. Cl.[7] ..... B32B 3/02; D04H 18/00
(52) U.S. Cl. ..... 428/172; 428/192; 28/115
(58) Field of Search ..... 428/172, 167, 428/192; 112/80.4, 80.01, 136, 470.01; 28/117, 115; 223/109 R, 106, 108, 120; 248/474

(56) References Cited

U.S. PATENT DOCUMENTS 5,813,101 A * 9/1998 Fehrer ..... 28/114

FOREIGN PATENT DOCUMENTS

AT 392 095 7/1990

* cited by examiner

*Primary Examiner*—Donald J. Loney
(74) *Attorney, Agent, or Firm*—Collard & Roe, P.C.

(57) ABSTRACT

There is described a needle board (1) for a device for needling a web, comprising a board body (2) of a light metal alloy, in particular a magnesium-aluminum alloy, and a plastic coating (3) cast onto the board body (2) on the side of the board facing the needle tips. To create advantageous constructional conditions it is proposed that the board body (2) preferably consisting of a cross-cut extruded section has undercut grooves (7) at its edges on the side of the board covered by the plastic coating (3), where the plastic coating (3) cast thereon positively fills the undercut grooves (7).

3 Claims, 1 Drawing Sheet

NEEDLE BOARD FOR A DEVICE FOR NEEDLING A WEB

FIELD OF THE INVENTION

This invention relates to a needle board for a device for needling a web, comprising a board body made of a light metal alloy, in particular a magnesium-aluminum alloy, and a plastic coating cast onto the board body on the side of the board facing the needle tips.

DESCRIPTION OF THE PRIOR ART

To obtain a good fixation of the needles on the one hand and on the other hand a good needle guidance in a needle board for a device for needling a web, it is known (AT 392 095 B) to provide the board body with an elastic plastic coating on the side of the board facing the needle tips, before the through holes for the needles are drilled into the needle board. As during this drilling operation in the vicinity of the elastic coating a noticeable elastic displacement of material is obtained, which upon withdrawal of the drills leads to a reduced hole diameter as compared to the subsequent through hole in the board body, the needles, whose needle butts are supported on the board body on the opposite side thereof, can easily be retained by the plastic coating. This holding and guiding function of the plastic coating can, however, only be ensured with a firm connection between the plastic coating and the board body. To prevent a possible detachment of the plastic coating from the board body, the plastic coatings cannot only be bonded, but also be screwed to the board body, which involves, however, an additional effort.

SUMMARY OF THE INVENTION

It is therefore the object underlying the invention to design a needle board as described above for a device for needling a web such that a safe connection between the plastic coating and the board body can be ensured without having to accept an additional effort.

This object is solved by the invention in that the board body preferably consisting of a cross-cut extruded section has undercut grooves at its edges on the side of the board covered by the plastic coating, where the plastic coating cast thereon positively fills the undercut grooves.

The formation of the board body as an extruded section offers the simple possibility of providing undercut grooves at the edges, without having to perform an additional machining of the board body, although in special cases it is of course also possible to mill the undercut grooves into the board body by taking an additional effort. However, the board body is advantageously formed of a longitudinal portion of an extruded section, onto which the plastic coating, preferably of polyurethane, is cast. Independent of whether the undercut grooves have been prepared by the corresponding formation of the extruded section or must first be incorporated therein, the plastic material will flow into the undercut grooves and positively fill the same, so that upon curing the plastic coating cast thereon the same is additionally anchored in the undercut grooves of the board body, which involves the required safety with respect to a detachment of the plastic coating from the board body, namely without an additional effort, because the plastic coating must merely be cast onto the board body in a conventional way.

Although different cross-sectional shapes are possible for the undercut grooves of the board body, particularly advantageous constructional conditions are obtained when the grooves at the edges of the board body have a dovetailed cross-section.

BRIEF DESCRIPTION OF THE DRAWING

In the drawing, the subject-matter of the invention is represented by way of example, wherein.

DESCRIPTION OF THE PREFERRED EMBODIMENT

Figure 1:
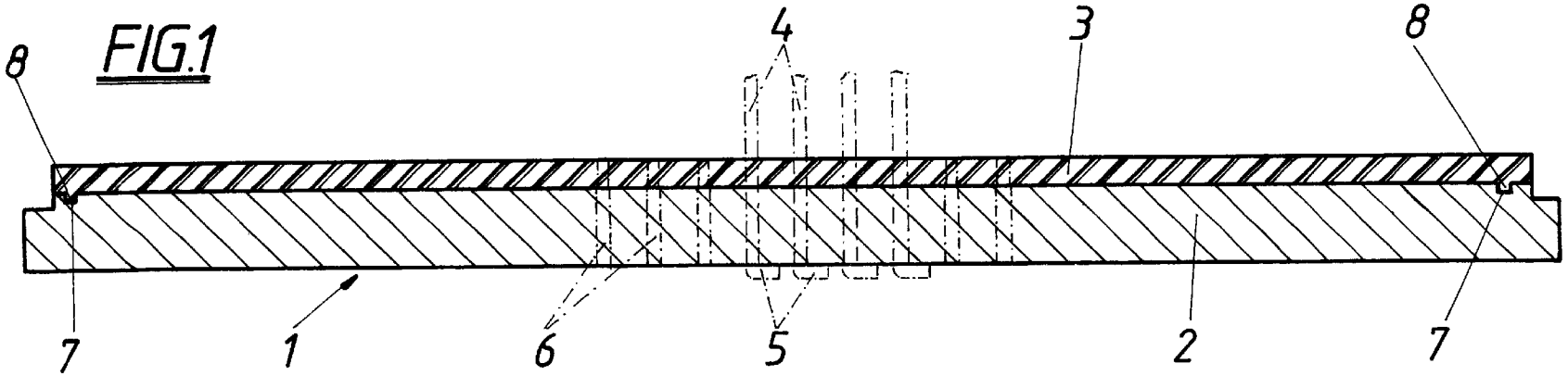
FIG. 1 shows an inventive needle board in a simplified cross-section.
Figure 2:
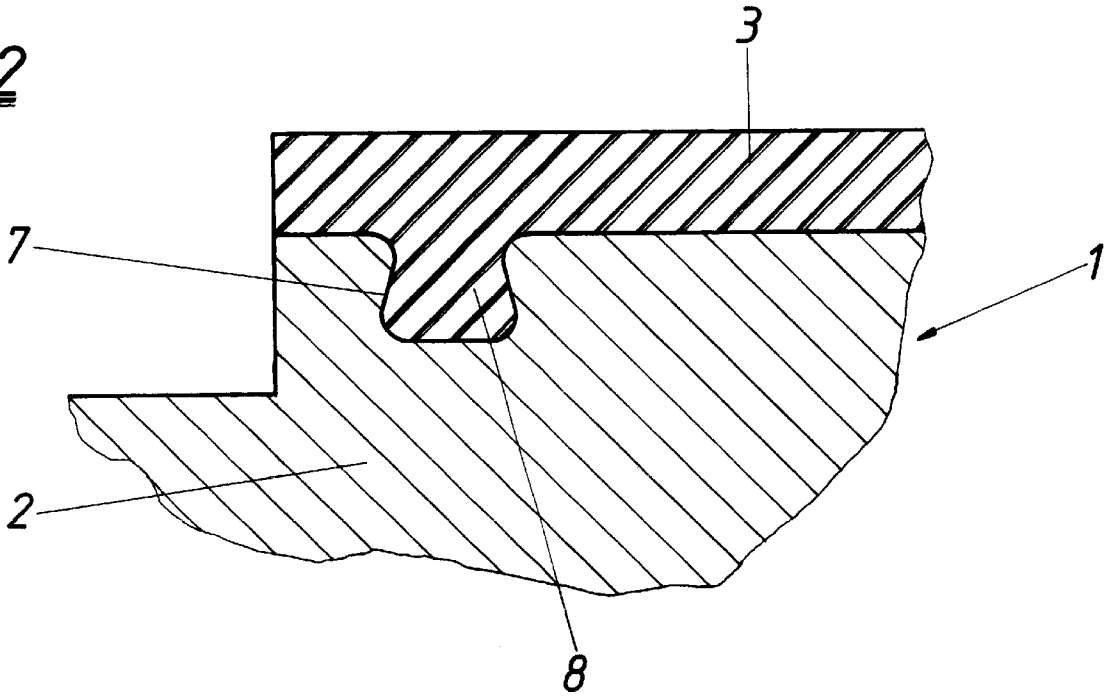
FIG. 2 shows a cross-section of the needle board in the vicinity of a groove at the edge on a larger scale.

In accordance with the illustrated embodiment shown in FIGS. 1 and 2, the needle board 1 to be inserted in a device for needling a web substantially includes a board body 2 and an elastic plastic coating 3 of polyurethane provided on the side of the board facing the web to be needled. For inserting needles 4, which are shot into the needle board 1 from the side of the board facing away from the plastic coating 3 until the angled needle butts 5 rest against the board body 2, the board body 2 is drilled together with the plastic coating 3. Some of these drilled holes 6 are indicated in FIG. 1 in dash-dotted lines like the needles 4.

In contrast to conventional needle boards of this kind the inventive needle board has two undercut grooves 7 at its edges, which form a dovetailed cross-section and serve to additionally anchor the plastic coating 3. To avoid that these undercut grooves 7 must be incorporated in the board body 2 in a separate operation, the board body 2 consists of a cross-cut extruded section of a magnesium-aluminum alloy, which despite a comparatively low weight ensures the required strength.

Since the plastic coating 3 is cast onto the side of the board facing the needle tips, which is provided with the undercut grooves 7, the plastic material will flow into the grooves 7 when it is applied onto the board body 2, and will positively fill the grooves, so that when the plastic coating is cured, the additional anchorage by section ribs 8 of the plastic coating, which are positively engaging into the undercut grooves 7, is ensured without any further effort.

What is claimed is:

1. A needle board for a device for needling a web, comprising a board body of a light metal alloy, and a plastic coating cast onto the board body on the side of the board body facing the needle tips, wherein the board body has undercut grooves at its edges on the side of the board body covered by the plastic coating, the plastic coating cast thereon completely filling the undercut grooves.

2. The needle board as claimed in claim 1, wherein the undercut grooves of the board body have a dovetailed cross-section.

3. The needle board as claimed in claim 1, wherein the board body consists of a cross-cut extruded section.

* * * * *

UNITED STATES PATENT AND TRADEMARK OFFICE

CERTIFICATE OF CORRECTION

PATENT NO. : 6,444,292 B1
DATED : September 3, 2002
INVENTOR(S) : L. Legl

It is certified that error appears in the above-identified patent and that said Letters Patent is hereby corrected as shown below:

Title page,
Item [30], Foreign Application Priority Data, should read
-- Feb. 15, 1999 (AT) …….. A 213/99 --.

Signed and Sealed this

Twentieth Day of May, 2003

JAMES E. ROGAN
*Director of the United States Patent and Trademark Office*